US009291310B2

(12) United States Patent
Nakazono

(10) Patent No.: US 9,291,310 B2
(45) Date of Patent: Mar. 22, 2016

(54) TANK-INTEGRATED PUMP UNIT AND RESERVOIR TANK

(71) Applicant: HITACHI AUTOMOTIVE SYSTEMS STEERING, LTD., Hiki-gun, Saitama (JP)

(72) Inventor: Tomohiko Nakazono, Fujisawa (JP)

(73) Assignee: HITACHI AUTOMOTIVE SYSTEMS STEERING, LTD., Hiki-Gun, Saitama (JP)

( * ) Notice: Subject to any disclaimer, the term of this patent is extended or adjusted under 35 U.S.C. 154(b) by 288 days.

(21) Appl. No.: 13/859,377

(22) Filed: Apr. 9, 2013

(65) Prior Publication Data

US 2014/0076433 A1 Mar. 20, 2014

(30) Foreign Application Priority Data

Sep. 19, 2012 (JP) ..... 2012-205134

(51) Int. Cl.
*F17D 1/00* (2006.01)

(52) U.S. Cl.
CPC ..... *F17D 1/00* (2013.01); *Y10T 137/85978* (2015.04)

(58) Field of Classification Search
CPC ..... B62D 5/07
USPC ..... 60/453
See application file for complete search history.

(56) References Cited

U.S. PATENT DOCUMENTS

| | | | | |
|---|---|---|---|---|
| 3,692,039 | A * | 9/1972 | Ewald et al. | 137/115.14 |
| 3,977,189 | A * | 8/1976 | Kubik | 60/453 |
| 4,043,127 | A * | 8/1977 | Kubik | 60/453 |
| 4,454,717 | A * | 6/1984 | Wade et al. | 60/453 |
| 5,820,356 | A | 10/1998 | Ogbuaku | |
| 6,311,724 | B1 * | 11/2001 | Tracey et al. | 137/550 |
| 6,913,040 | B2 * | 7/2005 | Crossman et al. | 137/587 |
| 7,918,295 | B2 * | 4/2011 | Kamman | 180/53.4 |

FOREIGN PATENT DOCUMENTS

| | | | |
|---|---|---|---|
| JP | S55-039358 | U | 3/1980 |
| JP | 58-058119 | A | 4/1983 |
| JP | 02-237867 | A | 9/1990 |
| JP | 02-237867 | A | 9/1990 |
| JP | 2782221 | B2 * | 7/1998 |

* cited by examiner

*Primary Examiner* — Thomas E Lazo
(74) *Attorney, Agent, or Firm* — Foley & Lardner LLP

(57) ABSTRACT

A tank-integrated pump unit includes a reservoir tank fixed to a pump body. The body of the reservoir tank includes an introduction opening for introducing working fluid from an external hydraulic device into the body. A filter member is arranged in the body for filtering working fluid introduced through the introduction opening. A suction passage connection portion is connected to a suction hole of a pump body. The suction passage connection portion includes a body-side opening through a wall of the body. The body-side opening is located below a predetermined level of working fluid and above a lowermost position in the body. A pressure chamber is defined in the body, and located below the body-side opening of the suction passage connection portion. The introduction opening faces the pressure chamber. The filter member covers an upper side of the pressure chamber.

18 Claims, 7 Drawing Sheets

TANK-INTEGRATED PUMP UNIT AND RESERVOIR TANK

BACKGROUND OF THE INVENTION

The present invention relates to a tank-integrated pump unit where a reservoir tank is integrally provided with a pumping device, wherein the pumping device is employed by a power steering device or the like of an automotive vehicle, and the reservoir tank stores working fluid for used in the pumping device, and relates to a reservoir tank used in such a tank-integrated pump unit.

Japanese Patent Application Publication H2-237867 discloses a tank-integrated pump unit that is mounted on a vehicle in such an upright attitude that a reservoir tank is arranged directly above a pumping device, and a tank-integrated pump unit that is mounted on a vehicle in such an inclined attitude that the whole of the tank-integrated pump unit is inclined in an engine room, to satisfy a requirement about engine room layout.

SUMMARY OF THE INVENTION

In such a tank-integrated pump unit mounted on a vehicle in an inclined attitude, a reservoir tank is formed with an opening of a fluid passage for supplying working fluid to a pumping device, wherein the opening is located above a lowermost position in the reservoir tank in a vertical direction, and working fluid in the reservoir tank is brought to the opening naturally by gravity. Accordingly, working fluid present at a lower position in the internal space of the reservoir tank than the opening is unavailable. This means that the lower space for storing working fluid is the so-called dead space, and is therefore disadvantageous in view of compactness of the unit.

In view of the foregoing, it is desirable to provide a tank-integrated pump unit in which such a dead space is effectively used to improve space efficiency, and which can be thereby made compact.

According to one aspect of the present invention, a tank-integrated pump unit comprises: a pump body including: a portion defining an accommodating space; a portion defining a suction passage; an outside portion defining a suction hole hydraulically connected to the suction passage; and a portion defining a discharge passage; a pumping part arranged in the accommodating space, and configured to perform a pumping action by being driven by rotation of a drive shaft, and discharge working fluid to an external hydraulic device through the discharge passage; and a reservoir tank fixed to the pump body, and configured to store working fluid, wherein the reservoir tank includes: a body configured store working fluid, wherein the body includes a wall including a portion defining an introduction opening configured to introduce working fluid from the external hydraulic device into the body; a fixing device configured to fix the body to the pump body; a filter member arranged in the body, and configured to filter working fluid introduced through the introduction opening; a suction passage connection portion connected to the suction hole of the pump body, wherein the suction passage connection portion includes a body-side opening through the wall of the body, wherein the body-side opening is located below a predetermined level of working fluid and above a lowermost position in the body in a vertical direction; and a pressure chamber defined in the body, and located below the body-side opening of the suction passage connection portion in the vertical direction, wherein the introduction opening faces the pressure chamber, and wherein the filter member is arranged at an upper side of the pressure chamber.

According to another aspect of the invention, a reservoir tank for a tank-integrated pump unit, wherein the tank-integrated pump unit includes a pumping device for supplying working fluid to an external hydraulic device, the reservoir tank comprises: a body configured store working fluid, wherein the body includes a wall including a portion defining an introduction opening configured to introduce working fluid from the external hydraulic device into the body; a fixing device configured to fix the body to the pump body; a filter member arranged in the body, and configured to filter working fluid introduced through the introduction opening; a suction passage connection portion connected to the pumping device, wherein the suction passage connection portion includes a body-side opening through the wall of the body, wherein the body-side opening is located below a predetermined level of working fluid and above a lowermost position in the body in a vertical direction; and a pressure chamber defined in the body, and located below the body-side opening of the suction passage connection portion in the vertical direction, wherein the introduction opening faces the pressure chamber, and wherein the filter member is arranged at an upper side of the pressure chamber.

DETAILED DESCRIPTION OF THE INVENTION

Figure 1:
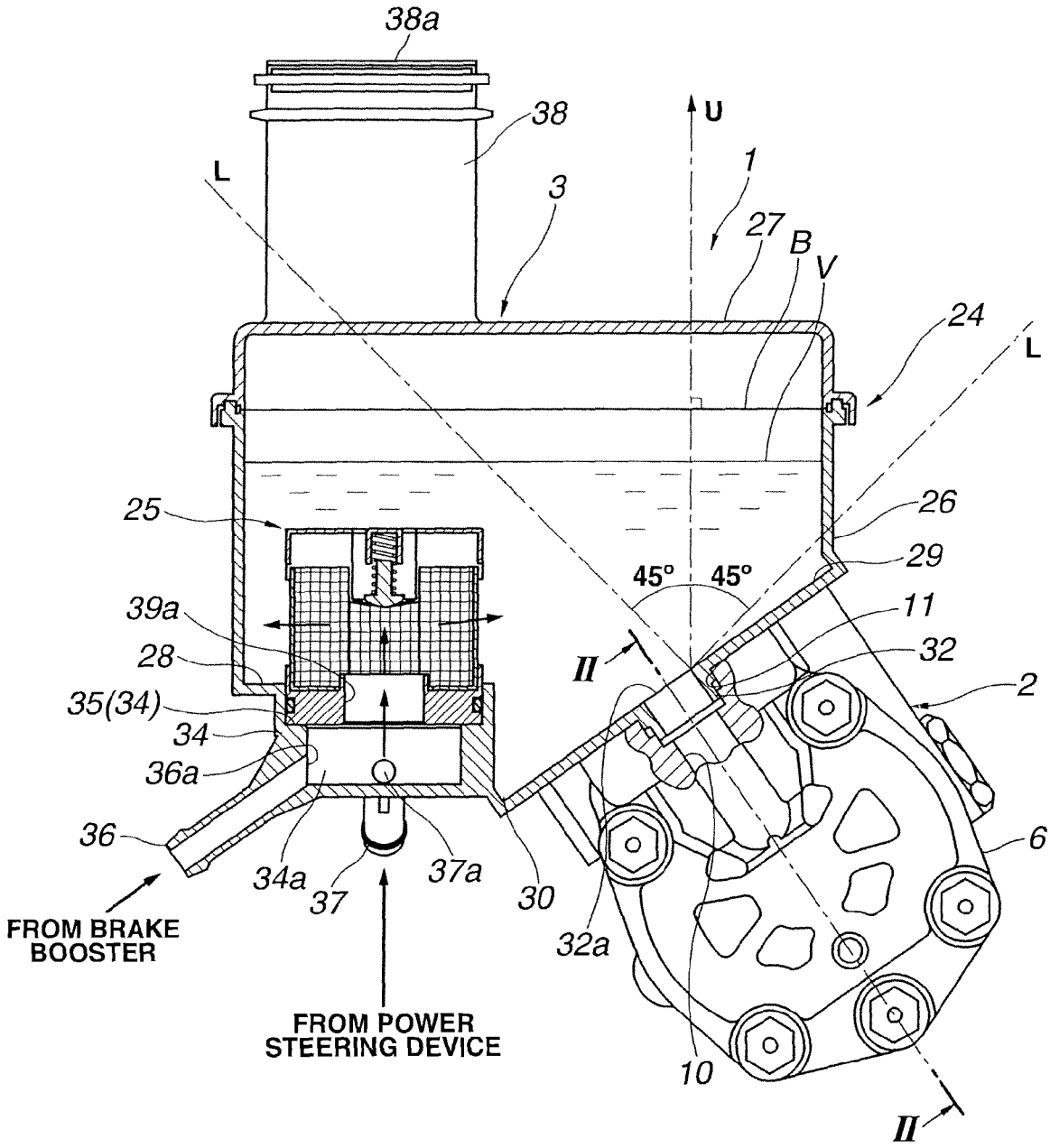
FIG. 1 is a schematic diagram showing a tank-integrated pump unit according to an embodiment of the present invention.
Figure 2:
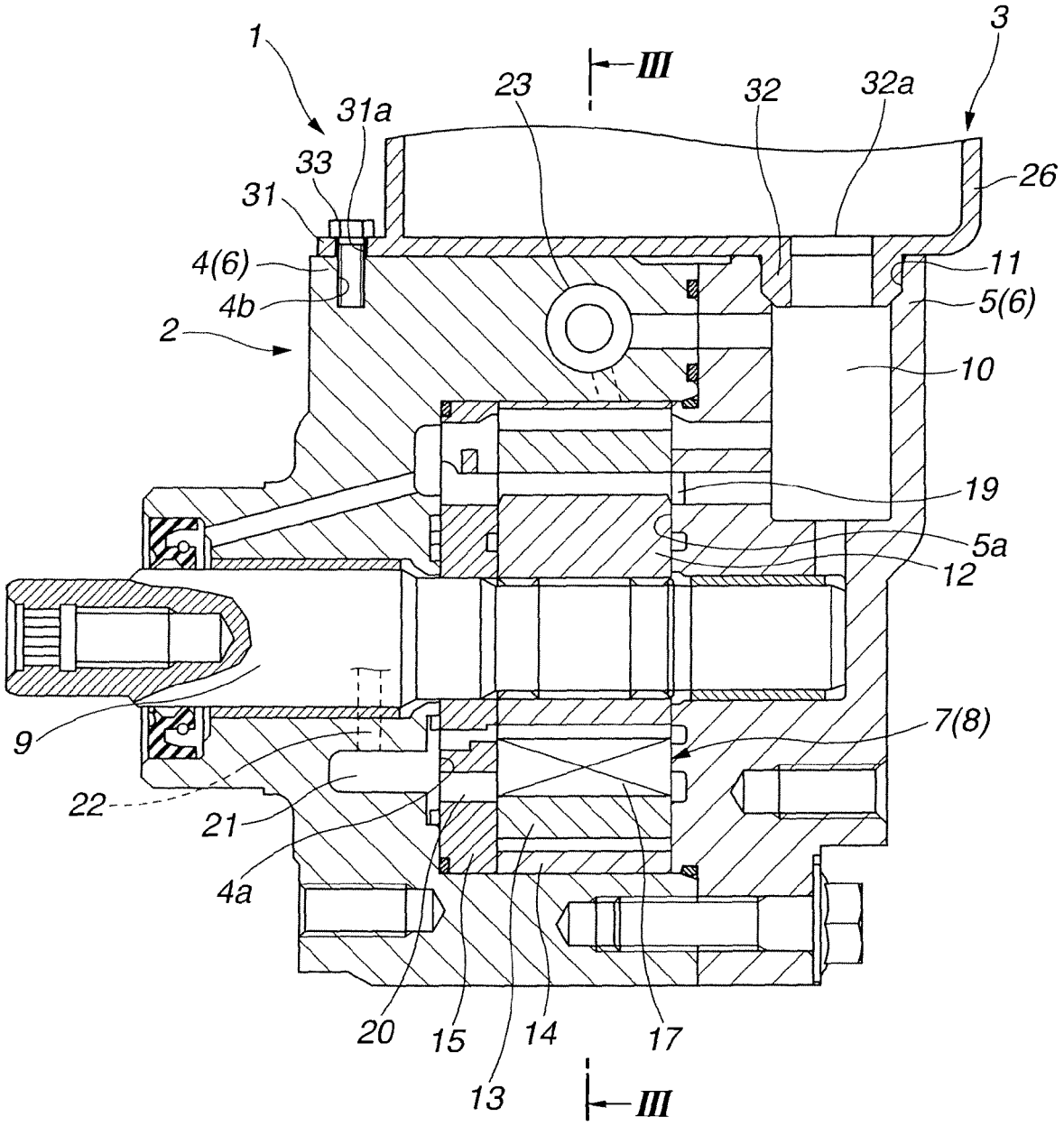
FIG. 2 is a cross-sectional view taken along a line indicated by II-II in FIG. 1.
Figure 3:
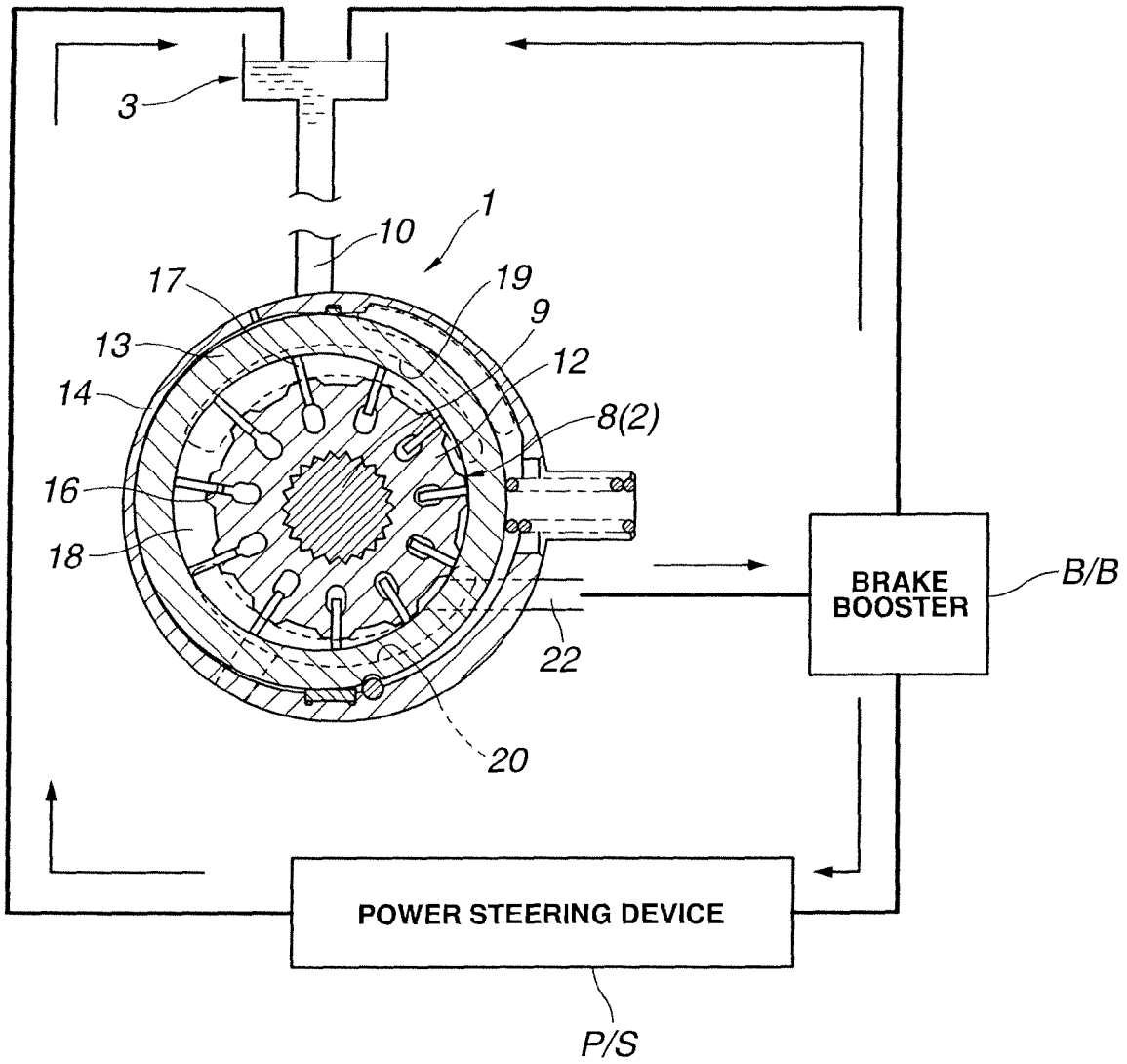
FIG. 3 is a schematic diagram showing a hydraulic circuit of the tank-integrated pump unit of FIG. 1, and also showing a cross-sectional view taken along the line indicated by in FIG. 2.

As shown in FIGS. 1 to 3, a tank-integrated pump unit 1 generally includes a pumping device 2 and a reservoir tank 3. Pumping device 2 is configured to feed working fluid to an external hydraulic system which includes a power steering device "P/S" and a brake booster "B/B" in this example. Reservoir tank 3 is fixed to pumping device 2, and configured to store working fluid for use in pumping device 2.

In FIG. 1, pumping device 2 is fixed to a support member of a vehicle body not shown in such an inclined attitude that the whole of pumping device 2 is inclined in the counterclockwise direction in FIG. 1 by a predetermined angle from the vertical direction, for minimizing the entire size of the tank-integrated pump unit 1 in the vertical direction, and thereby satisfying a requirement about vehicle component layout. On the other hand, reservoir tank 3 includes an inclined bottom wall portion 29 to which pumping device 2 is attached, wherein inclined bottom wall portion 29 is inclined by the predetermined angle from the vertical direction. In FIG. 1, an arrow "U" indicates an upward orientation in the vertical direction.

Pumping device 2 is a variable displacement vane pump which generally includes a pump body 6, a pumping part 8, and a drive shaft 9. Pump body 6 is composed of a front body 4 and a rear body 5 which are coupled to each other, to define an accommodating space for accommodating the pumping part 8. Drive shaft 9 is inserted through the accommodating space 7 of pump body 6, and configured to rotate and drive the pumping part 8 to perform a pumping action.

Rear body 5 is formed with a suction passage 10 and a suction plug connection hole (or suction hole) 11. Suction passage 10 is bored in rear body 5. Suction plug connection hole 11 is formed through an upper side of rear body 5, and is hydraulically connected to suction passage 10. Suction plug connection hole 11 is configured to receive insertion and fitting of a suction plug (or suction passage connection portion) 32, which is a suction passage connection portion of reservoir tank 3 as described in detail below. Working fluid in reservoir tank 3 is supplied to pumping part 8 of pumping device 2 through the suction plug 32.

Front body 4 is formed with a front body bolt hole 4*b*, which is bored in an upper side of front body 4. Front body bolt hole 4*b*, a flange bolt hole 31*a* of reservoir tank 3, and a bolt 33 inserted into front body bolt hole 4*b* and flange bolt hole 31*a*, serve as a fixing device or means to fix the reservoir tank 3 to an upper flat surface of pump body 6.

Pumping part 8 includes a rotor 12, a cam ring 13, an adapter ring 14, and a pressure plate 15. Rotor 12 is coupled to drive shaft 9, and is rotated by drive shaft 9. Cam ring 13 has an annular shape, and is arranged to surround the rotor 12, and is configured to swing about rotor 12 with a variable eccentricity with respect t rotor 12. Adapter ring 14 has an annular shape, and surrounds cam ring 13, and is fixedly fitted to the inner peripheral surface of the wall defining the accommodating space 7. Pressure plate 15 has a disc-shape, and is arranged at an inner bottom surface 4*a* of front body 4, defining the accommodating space 7.

The outer periphery of rotor 12 is formed with a plurality of slots 16 extending radially of rotor 12, wherein slots 16 are arranged at equal intervals. Each slot 16 accommodates a vane 17. Each vane 17 is a rectangular plate, and is movable outward and inward in the corresponding slot 16 radially of rotor 12. The tip of each vane 17 is maintained in contact with the inner peripheral surface of cam ring 13, so that the annular space between rotor 12 and cam ring 13 is divided by vanes 17 into a plurality of pumping chambers 18. Rotor 12 is rotated by drive shaft 9 in the counterclockwise direction of FIG. 3. Rotation of rotor 12 causes each pumping chamber 18 to expand and contract repeatedly, and perform a pumping action.

Rear body 5 has an inside surface 5*a* facing the accommodating space 7, wherein inside surface 5*a* is formed with a first suction port 19. First suction port 19 has an arc-shape extending in the circumferential direction of rear body 5 in the plan view of rear body 5, and is located in a region referred to as suction region where each pumping chamber 18 gradually expands along with rotation of rotor 12. First suction port 19 is hydraulically connected to suction passage 10 and suction plug connection hole 11. In this construction, working fluid introduced into suction passage 10 through the suction plug 32 is sucked into each pumping chamber 18 by the pump suction action in the suction region.

Pressure plate 15 has a surface facing the rotor 12, wherein the surface is formed with a first discharge port 20. First discharge port 20 has an arc-shape extending in the circumferential direction of pressure plate 15 in the plan view of pressure plate 15, and is located in a region referred to as discharge region where each pumping chamber 18 gradually contracts along with rotation of rotor 12. First discharge port 20 is hydraulically connected to a discharge passage 22 through a pumping-device-side pressure chamber 21 that is bored in inner bottom surface 4*a* of front body 4 facing the pressure plate 15. In this construction, working fluid discharged from each pumping chamber 18 by the pump discharge function in the discharge region is discharged to the outside of pump body 6 through the pumping-device-side pressure chamber 21 and discharge passage 22.

Pumping device 2 is provided with a control valve 23 as shown in FIG. 2, which is configured to control the pump discharge pressure by hydraulically changing the eccentricity of cam ring 13 with respect to rotor 12.

As shown in FIG. 3, the working fluid discharged from pumping device 2 is introduced into brake booster B/B and also into power steering device P/S, which are arranged in series in the hydraulic circuit, and is used to produce hydraulic power, and is finally returned to reservoir tank 3. In this way, reservoir tank 3 is shared and used by power steering device P/S and brake booster B/B.

The following describes detailed configuration of reservoir tank 3. As shown in FIG. 1, reservoir tank 3 includes a tank body 24, and a filter member 25. Tank body 24 is made of a thermoplastic resin such as a polyamide resin. Filter member 25 is mounted in tank body 24 for filtering working fluid returned from power steering device P/S and brake booster B/B.

Figure 4:
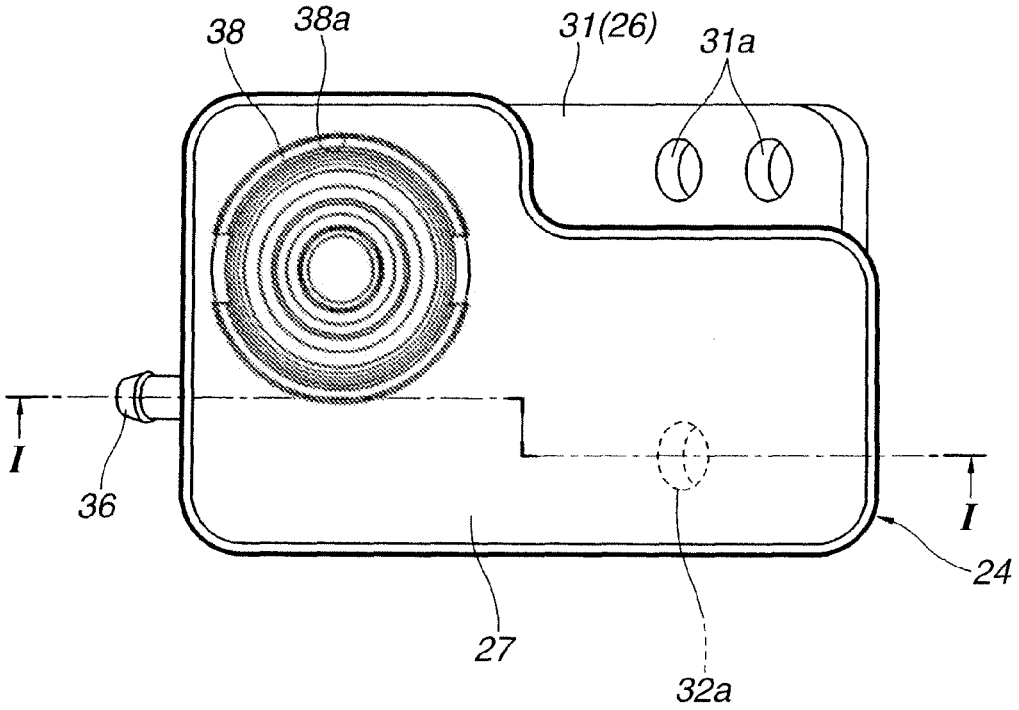
FIG. 4 is a plan view of a reservoir tank in a state separated from the tank-integrated pump unit of FIG. 1.
Figure 5:
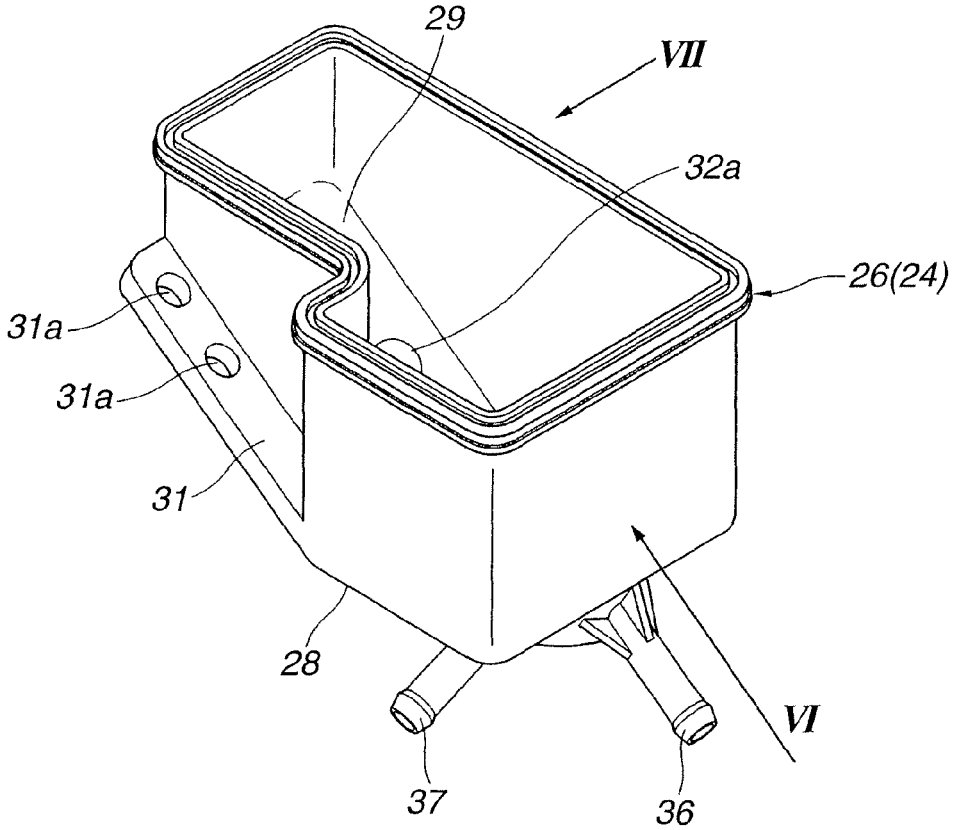
FIG. 5 is a perspective view of a lower tank in a state separated from the tank-integrated pump unit of FIG. 1.
Figure 6:
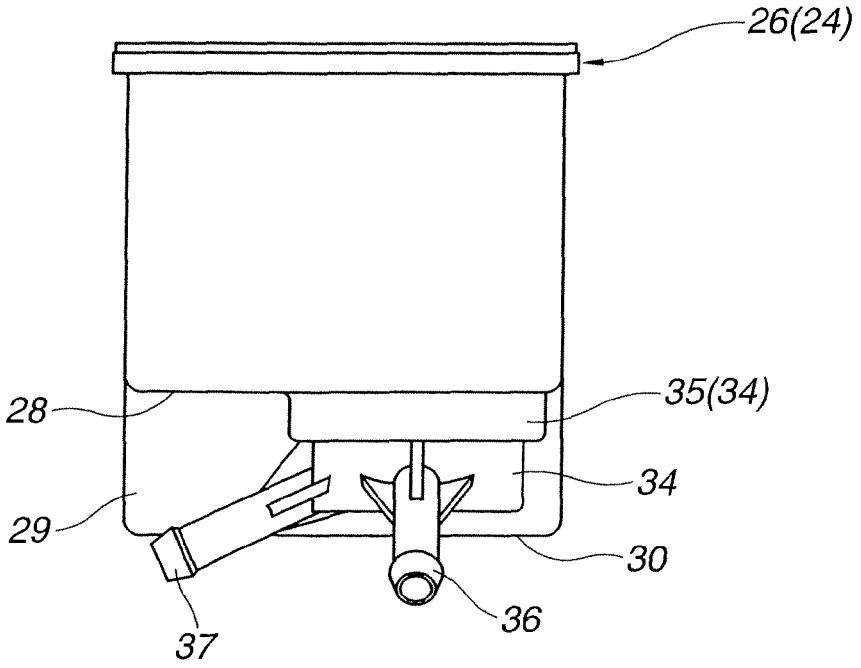
FIG. 6 is a perspective view of the lower tank of FIG. 5 in a direction of an arrow VI in FIG. 5.

As shown in FIGS. 1 and 4, tank body 24 is composed of upper and lower separate parts, namely, a lower tank 26 and an upper cover 27, and is configured to store a predetermined quantity of working fluid. Lower tank 26 is attached to pumping device 2. Upper cover 27 covers the upper opening of lower tank 26. Lower tank 26 and upper cover 27 are joined to each other to form a hermetic tank, wherein the boundary between lower tank 26 and upper cover 27 is indicated by "B" in FIG. 1. In FIG. 1, "V" indicates a predetermined level of working fluid.

As shown in FIGS. 1 and 5 to 8, lower tank 26 is a vessel in the form of a tubular shape having a bottom or in the form of a bowl, and has a rectangular shape in the plan view. The bottom of lower tank 26 is composed of a horizontal bottom wall portion 28 and an inclined bottom wall portion 29. Horizontal bottom wall portion 28 has a rectangular shape in the plan view, and is parallel to the working fluid level V. Inclined bottom wall portion 29 has a rectangular shape in the plan view, and descends toward horizontal bottom wall portion 28. Lower tank 26 is also formed integrally with a chamber portion 34, which has a cylindrical shape and projects downward from horizontal bottom wall portion 28. Horizontal bottom wall portion 28 is located above a lowermost portion (deepest portion) 30 of inclined bottom wall portion 29, and is above an opening 32*a* of suction plug 32. The lowermost portion 30 of inclined bottom wall portion 29 is located at a lowermost position in the whole internal space of lower tank 26.

Figure 7:
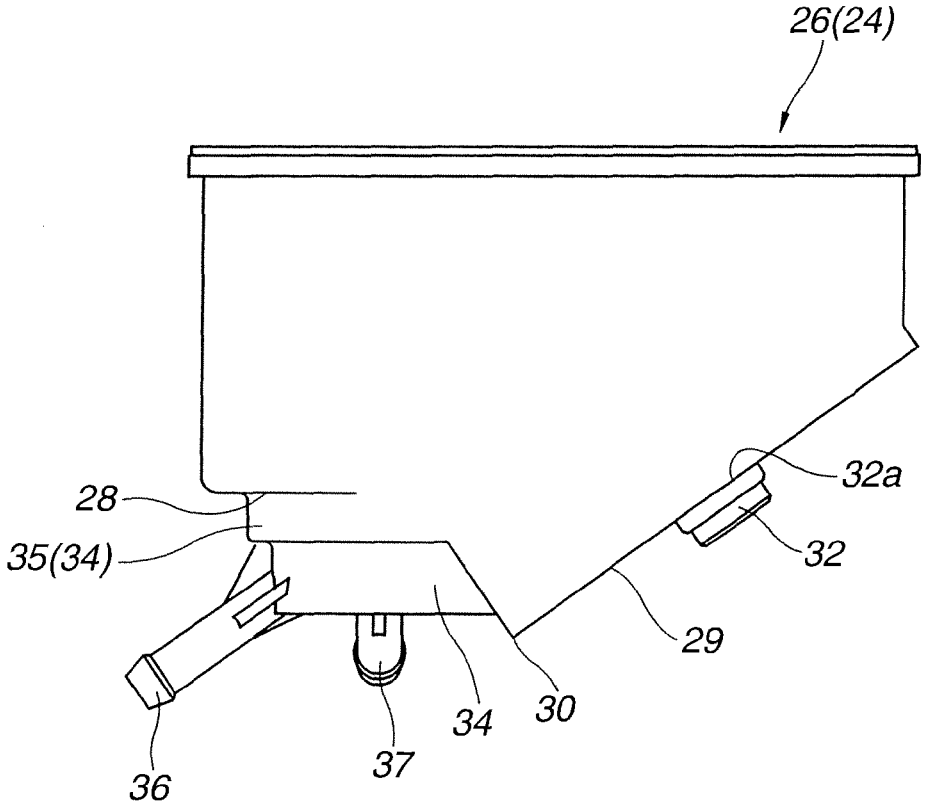
FIG. 7 is a perspective view of the lower tank of FIG. 5 in a direction of an arrow VII in FIG. 5.
Figure 8:
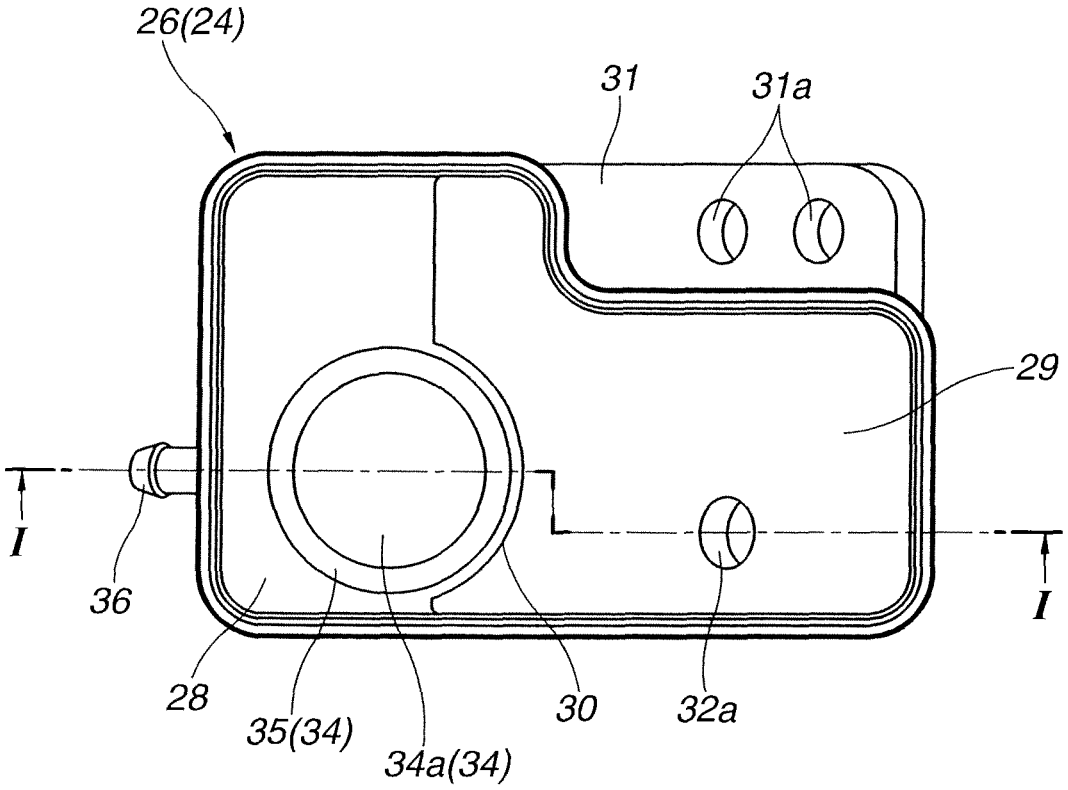
FIG. 8 is a plan view of the lower tank of FIG. 5.

Inclined bottom wall portion 29 is formed with a flange portion 31 that is an extension of inclined bottom wall portion 29, and has the same angle of inclination. Flange portion 31 serves as a fixing device or means to connect and fix the lower tank 26 to pump body 6. As shown in FIGS. 1 and 7, inclined bottom wall portion 29 is provided with suction plug 32 at a substantially central position in the longitudinal direction of inclined bottom wall portion 29. Suction plug 32 has a cylindrical shape, and has opening 32*a* which is located above the lowermost portion 30 and below the working fluid level V. As described above, the flange portion 31 is fixed to pump body 6 by bolt 33 that is inserted through the flange bolt hole 31*a* and front body bolt hole 4*b*. Suction plug 32 is fitted in suction plug connection hole 11 of pumping device 2.

As shown in FIG. 1, filter member 25 is attached to horizontal bottom wall portion 28. Filter member 25 has a cylindrical shape. The lower side of filter member 25 is arranged to face the chamber portion 34. Chamber portion 34 has a hollow cylindrical shape having a bottom, and is located directly below the filter member 25.

Specifically, as shown in FIGS. 1 and 6 to 9, the internal space of chamber portion 34 is defined as a pressure chamber 34*a* having a predetermined volumetric capacity. Lower tank 26 is formed with a step seat portion 35 directly above the pressure chamber 34*a*. As viewed in the vertical direction, step seat portion 35 has a circular shape having a larger size or diameter than pressure chamber 34*a*. Filter member 25 is mounted on step seat portion 35, covering the upper side of pressure chamber 34*a*.

Chamber portion 34 is formed integrally with a power-steering-device-side introduction plug 37 and a brake-booster-side introduction plug 36. Power-steering-device-side introduction plug 37 serves to introduce into tank body 24 the working fluid returned from power steering device P/S. Brake-booster-side introduction plug 36 serves to introduce into tank body 24 the working fluid returned from brake booster B/B. Power-steering-device-side introduction plug 37 has an introduction opening 37*a*, and brake-booster-side introduction plug 36 has an introduction opening 36*a*, wherein both of introduction opening 37*a* and introduction opening 36*a* open to and face the pressure chamber 34*a*. The lowermost portion of filter member 25 is located below the opening 32*a* of suction plug 32 in the internal space of tank body 24, whereas the whole of pressure chamber 34*a* is below the opening 32*a* of suction plug 32, and above the lowermost portion 30 of inclined bottom wall portion 29 in the internal space of tank body 24.

As shown in FIGS. 1 and 4, upper cover 27 of tank body 24 has a bowl shape which is substantially identical to that of lower tank 26 in the plan view. Upper cover 27 is formed with an infusion pipe 38 which projects upward in the vertical direction, and has a hollow cylindrical shape. Infusion pipe 38 has an infusion opening 38*a* at the uppermost end. A predetermined amount of working fluid is infused into tank body 24 through the infusion opening 38*a*. The infusion opening 38*a* of infusion pipe 38 is closed hermetically by a cap not shown. The infusion opening 38*a* is located with an offset from filter member 25 in the direction of depth (in the vertical direction in FIGS. 4 and 8). This feature serves to prevent working fluid from being leaked through the infusion opening 38*a*, even under a condition that reservoir tank 3 is inclined in the direction of depth.

Reservoir tank 3 is configured to satisfy a requirement that even when the level of working fluid is full and reservoir tank 3 is inclined at a maximum angle of 45 degrees, no working fluid is leaked through the infusion opening 38*a*. On the other hand, the opening 32*a* of suction plug 32 is required to be constantly below the working fluid level V, to prevent air from being trapped by pumping device 2.

Accordingly, in the present embodiment, the positional relationship between the opening 32*a* of suction plug 32 and the infusion opening 38*a* of infusion pipe 38 is set as shown in FIG. 1 so that the entire upper edge of the infusion opening 38*a* is within a region enclosed by two alternate long and short dash lines L, L, namely, both of two alternate long and short dash lines L, L pass under the entire upper edge of infusion opening 38*a*, where alternate long and short dash line L is drawn to extend upwardly from a reference point on a reference line at 45 degrees with respect to the reference line on each side of the reference line, wherein the reference point is the uppermost point of opening 32*a* of suction plug 32, and the reference line is a vertical line drawn to pass through the reference point.

As described above, tank body 24 is composed of upper cover 27 and lower tank 26 which are separate from each other before assembling. During assembling, filter member 25 is attached to the inside of lower tank 26, and upper cover 27 is thereafter attached to lower tank 26.

Figure 9:
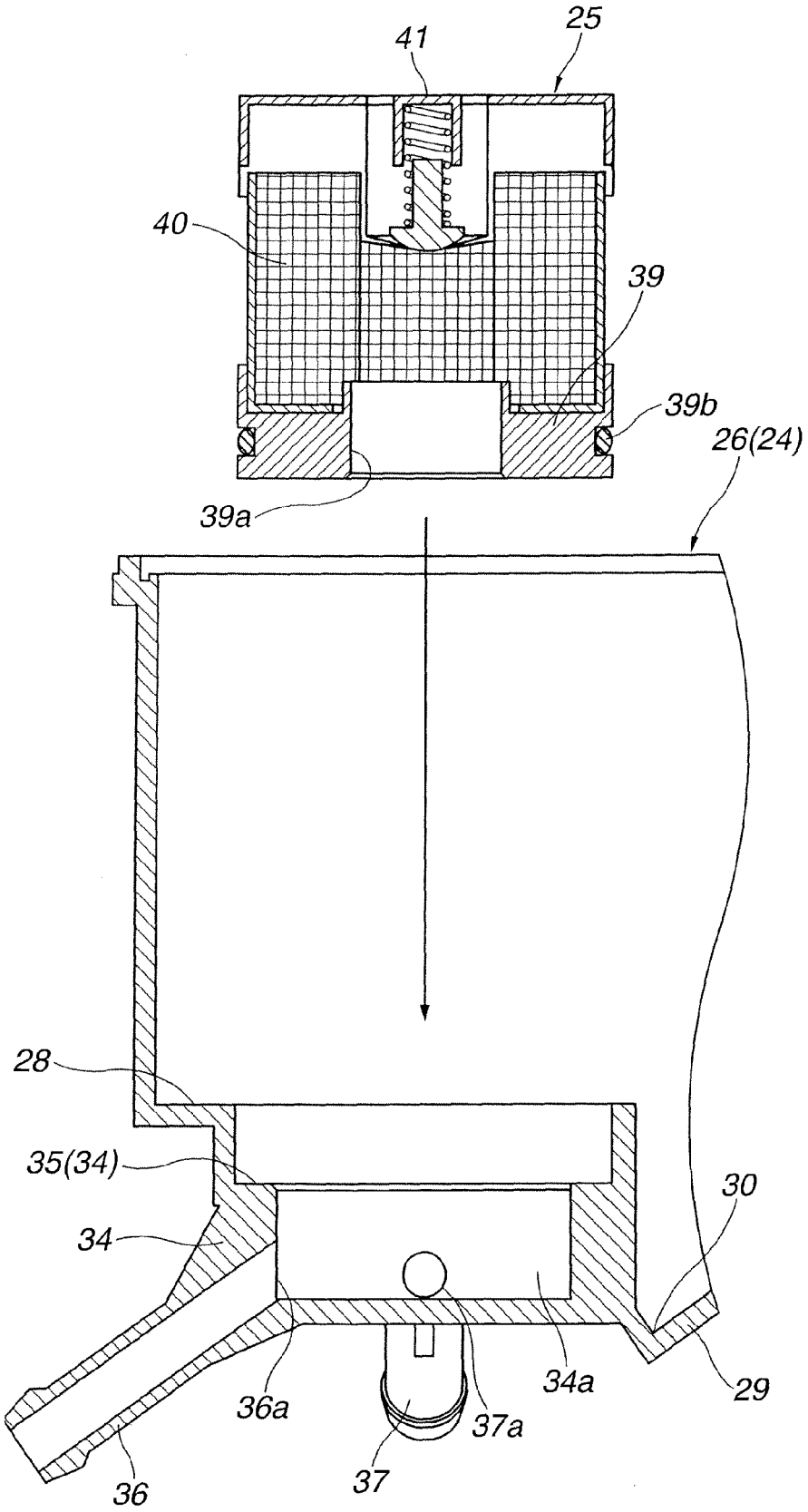
FIG. 9 is an enlarged partial view of the tank-integrated pump unit of FIG. 1 under a condition that a filter member is being attached to the reservoir tank.

As shown in FIG. 9, filter member 25 generally includes a filter case 39, and a filter element 40. Filter case 39 has a hollow cylindrical shape having a through-flow hole 39*a*, and is made of resin. Filter element 40 has an annular shape formed of a filter paper, and is mounted in filter case 39 under a condition that filter element 40 is folded like a bellows. Filter case 39 is fitted to step seat portion 35 of chamber portion 34 through a seal member 39*b*, and is thereby positioned and fixed. Filter member 25 is provided with a unidirectional valve 41. The construction that filter member 25 is attached to step seat portion 35 of chamber portion 34 causes the internal space of chamber portion 34 to serve as pressure chamber 34*a*.

In the tank-integrated pump unit 1 constructed as described above, working fluid returned from power steering device P/S and working fluid returned from brake booster B/B are discharged into tank body 24 through introduction opening 36*a* and introduction opening 37*a*, and collected into the pressure chamber 34*a* of chamber portion 34. The working fluid introduced into pressure chamber 34*a* flows through the through-flow hole 39*a* of filter case 39 and through the filter member 25 into tank body 24, and then flows again into suction passage 10 of pumping device 2.

In the process described above, the cross-sectional flow area of working fluid passing through the filter member 25 is reduced by the through-flow hole 39*a* and by the flow resistance of filter element 40. This feature causes the internal space of chamber portion 34 to serve as pressure chamber 34*a*, and pressurize the introduced working fluid. The working fluid is pressurized at pressure chamber 34*a* and filter member 25 that are upstream of filter element 40, and is made to flow upward from the lower end to the upper end of filter member 25 against gravity, and is made to pass through the filter element 40, and is diffused entirely in the internal space of tank body 24. This feature serves to make the flow of working fluid slow, and thereby prevent the occurrence of bubbles in the working fluid, and thereby prevent the occurrence of problems such as cavitation and the like in pumping device 2.

As described above, the whole of pumping device 2 is inclined at the predetermined angle in the counterclockwise direction in FIG. 1 from the vertical direction, and is fixed to the support member of the vehicle body. As a result, as shown in FIG. 1, the opening 32*a* of suction plug 32 fitted in suction plug connection hole 11 of pumping device 2 is located above the lowermost position 30 in the internal space of tank body 24. This tends to cause that the working fluid accumulated below the opening 32*a* in the internal space of tank body 24, namely, the working fluid in the position of pressure chamber 34*a* and the like, is unavailable, and this space becomes a dead space, thus adversely affecting the space efficiency of tank-integrated pump unit 1.

However, in the present embodiment, the pressure chamber 34*a* is defined in a partial region of the internal space of tank body 24, wherein the region is below the opening 32*a* of suction plug 32. The provision of pressure chamber 34*a* serves to effectively use part of the dead space below the opening 32*a*, and improves the space efficiency, and thereby allows the tank-integrated pump unit to be made compact.

The construction that the lower side of filter member 25 is located below the opening 32*a* of suction plug 32 in the internal space of tank body 24, serves to replace part of the dead space of tank body 24 by the lower side of filter member 25 in addition to the effect of provision of the pressure chamber 34*a*, and thereby further improves the space efficiency, and thereby allows the tank-integrated pump unit to be made compact.

The feature that reservoir tank 3 is shared by or used for power steering device P/S and brake booster B/B serves to reduce the number of parts constituting the system including the power steering device P/S and brake booster B/B. This serves to reduce the manufacturing cost, and enhances the flexibility of engine room layout, and enhances the compactness of the whole system.

The feature that working fluid passing through the lower end to the upper end of filter member 25, and then passing through the filter element 40, is diffused in the internal space of tank body 24, serves to suppress the flow of working fluid in tank body 24, and thereby prevent the occurrence of bubbles in working fluid, and thereby prevent the occurrence of problems such as cavitation in pumping device 2.

On the other hand, unidirectional valve 41 in filter member 25 is configured to open only after situations such as a situation where the holes of filter element 40 might be clogged, and serve to return working fluid into tank body 24 without passing through filter element 40 in such situations.

Although filter element 40 of filter member 25 traps foreign objects and impurities, namely, contaminants, contained in working fluid, small contaminants may pass through the filter member 25. Most of the small contaminants fall along inclined bottom wall portion 29 and precipitate, and are finally collected at lowermost portion 30 of tank body 24. The feature that the lowermost portion 30 is located below the opening 32*a* of suction plug 32, serves to prevent the collected contaminants from being sucked by pumping device 2. The lowermost portion 30 of tank body 24 serves as a space for accommodating or accumulating impurities (impurity accommodating space). This also serves to effectively use the dead space of internal space of tank body 24 by replacing with the useful function.

The feature that the filter element 40 of filter member 25 is located directly above the pressure chamber 34*a* serves to allow contaminants in working fluid, which is introduced into pressure chamber 34*a*, to be accumulated by gravity also in pressure chamber 34*a*, and thereby enhance the function of trapping contaminants.

The entire contents of Japanese Patent Application 2012-205134 filed Sep. 19, 2012 are incorporated herein by reference.

Although the invention has been described above by reference to certain embodiments of the invention, the invention is not limited to the embodiments described above. Modifications and variations of the embodiments to described above will occur to those skilled in the art in light of the above teachings. The scope of the invention is defined with reference to the following claims.

What is claimed is:

1. A tank-integrated pump unit comprising:

a pump body including:

a portion defining an accommodating space;

a portion defining a suction passage;

an outside portion defining a suction hole hydraulically connected to the suction passage; and a portion defining a discharge passage;

a pumping part arranged in the accommodating space, and configured to perform a pumping action by being driven by rotation of a drive shaft, and discharge working fluid to an external hydraulic device through the discharge passage; and a reservoir tank fixed to the pump body, and configured to store working fluid, wherein the reservoir tank includes:

a body configured to store working fluid, wherein the body includes a wall including a portion defining an introduction opening configured to introduce working fluid from the external hydraulic device into the body;

a fixing device configured to fix the body to the pump body;

a filter member arranged in the body, and configured to filter working fluid introduced through the introduction opening;

a suction passage connection portion connected to the suction hole of the pump body, wherein the suction passage connection portion includes a body-side opening through the wall of the body, wherein the body-side opening is located below a predetermined level of working fluid and above a lowermost position in the body in a vertical direction; and a pressure chamber defined in the body, and located below the body-side opening of the suction passage connection portion in the vertical direction, wherein the introduction opening faces the pressure chamber, and wherein the filter member is arranged at an upper side of the pressure chamber, wherein an entire part of the pressure chamber is located below the body-side opening of the suction passage connection portion in the vertical direction.

2. The tank-integrated pump unit as claimed in claim 1, wherein the filter member includes a part located below the body-side opening of the suction passage connection portion in the vertical direction.

3. The tank-integrated pump unit as claimed in claim 1, wherein:

the external hydraulic device includes a power steering device and a brake booster;

the introduction opening includes an introduction opening hydraulically connected to the power steering device, and an introduction opening hydraulically connected to the brake booster; and the reservoir tank is configured to store working fluid introduced from the power steering device and the brake booster.

4. The tank-integrated pump unit as claimed in claim 1, wherein the filter member is located over the pressure chamber in the vertical direction.

5. The tank-integrated pump unit as claimed in claim 1, wherein the body includes a lower part and an upper part which are separate from each other at least before assembling.

6. The tank-integrated pump unit as claimed in claim 1, wherein the body includes therein an impurity accommodating space located below the body-side opening of the suction passage connection portion, and configured to accommodate an impurity in working fluid.

7. The tank-integrated pump unit as claimed in claim 6, wherein the wall of the body includes an inclined bottom wall portion descending from the body-side opening of the suction passage connection portion to the impurity accommodating space.

8. The tank-integrated pump unit as claimed in claim 1, wherein:

the body includes an infusion opening through the wall of the body;

the infusion opening is located at an upper side of the body in the vertical direction, wherein working fluid is infused into the body through the infusion opening; and the body-side opening of the suction passage connection portion is set so that a straight line extending upwardly from an uppermost point of the body-side opening at 45 degrees from the vertical direction passes under the infusion opening in the vertical direction.

9. The tank-integrated pump unit as claimed in claim 1, wherein:

the body includes a step seat portion located between the pressure chamber and the filter member;

the step seat portion has a larger size than the pressure chamber; and the filter member is mounted on the step seat portion to cover an opening of the pressure chamber.

10. A reservoir tank for a tank-integrated pump unit, wherein the tank-integrated pump unit includes a pumping device for supplying working fluid to an external hydraulic device, the reservoir tank comprising:

a body configured to store working fluid, wherein the body includes a wall including a portion defining an introduction opening configured to introduce working fluid from the external hydraulic device into the body;

a fixing device configured to fix the body to the pump body;

a filter member arranged in the body, and configured to filter working fluid introduced through the introduction opening;

a suction passage connection portion connected to the pumping device, wherein the suction passage connection portion includes a body-side opening through the wall of the body, wherein the body-side opening is located below a predetermined level of working fluid and above a lowermost position in the body in a vertical direction; and a pressure chamber defined in the body, and located below the body-side opening of the suction passage connection portion in the vertical direction, wherein the introduction opening faces the pressure chamber, and wherein the filter member is arranged at an upper side of the pressure chamber, wherein an entire part of the pressure chamber is located below the body-side opening of the suction passage connection portion in the vertical direction.

11. The reservoir tank as claimed in claim 10, wherein the filter member includes a part located below the body-side opening of the suction passage connection portion in the vertical direction.

12. The reservoir tank as claimed in claim 10, wherein:

the external hydraulic device includes a power steering device and a brake booster;

the introduction opening includes an introduction opening hydraulically connected to the power steering device, and an introduction opening hydraulically connected to the brake booster; and the reservoir tank is configured to store working fluid introduced from the power steering device and the brake booster.

13. The reservoir tank as claimed in claim 10, wherein the filter member is located over the pressure chamber in the vertical direction.

14. The reservoir tank as claimed in claim 10, wherein the body includes a lower part and an upper part which are separate from each other at least before assembling.

15. The reservoir tank as claimed in claim 10, wherein the body includes therein an impurity accommodating space located below the body-side opening of the suction passage connection portion, and configured to accommodate an impurity in working fluid.

16. The reservoir tank as claimed in claim 15, wherein the wall of the body includes an inclined bottom wall portion descending from the body-side opening of the suction passage connection portion to the impurity accommodating space.

17. The reservoir tank as claimed in claim 10, wherein:

the body includes an infusion opening through the wall of the body;

the infusion opening is located at an upper side of the body in the vertical direction, wherein working fluid is infused into the body through the infusion opening; and the body-side opening of the suction passage connection portion is set so that a straight line extending upwardly from an uppermost point of the body-side opening at 45 degrees from the vertical direction passes under the infusion opening in the vertical direction.

18. The reservoir tank as claimed in claim 10, wherein:

the body includes a step seat portion located between the pressure chamber and the filter member;

the step seat portion has a larger size than the pressure chamber; and the filter member is mounted on the step seat portion to cover an opening of the pressure chamber.

* * * * *